US006760712B1

(12) United States Patent
Bonissone et al.

(10) Patent No.: US 6,760,712 B1
(45) Date of Patent: Jul. 6, 2004

(54) AUTOMATIC TRAIN HANDLING CONTROLLER

(75) Inventors: Piero Patrone Bonissone, Schenectady, NY (US); Yu-To Chen, Niskayuna, NY (US); Pratap Shankar Khedkar, Cherry Hill, NJ (US); Paul Kenneth Houpt, Schenectady, NY (US); John Lewis Schneiter, Latham, NY (US)

(73) Assignee: General Electric Company, Niskayuna, NY (US)

( * ) Notice: Subject to any disclaimer, the term of this patent is extended or adjusted under 35 U.S.C. 154(b) by 455 days.

(21) Appl. No.: 09/690,128

(22) Filed: Oct. 17, 2000

Related U.S. Application Data

(63) Continuation-in-part of application No. 08/999,202, filed on Dec. 29, 1997.

(51) Int. Cl.[7] ..... G06F 165/00
(52) U.S. Cl. ..... 706/4; 701/19; 701/20
(58) Field of Search ..... 706/1–10; D12/36–51; 701/1–124

(56) References Cited

U.S. PATENT DOCUMENTS

| | | | | |
|---|---|---|---|---|
| 5,436,631 A | * | 7/1995 | Magori et al. | 342/42 |
| 5,459,665 A | * | 10/1995 | Hikita et al. | 701/118 |
| 5,544,059 A | * | 8/1996 | Hikita et al. | 701/117 |
| 5,983,144 A | * | 11/1999 | Bonissone et al. | 701/19 |
| 5,995,737 A | * | 11/1999 | Bonissone et al. | 703/8 |
| 6,125,311 A | * | 9/2000 | Lo | 701/29 |
| 6,243,694 B1 | * | 6/2001 | Bonissone et al. | 706/4 |

OTHER PUBLICATIONS

Automated fuzzy knowledge base generation and tuning Burkhardt, D.G.; Bonissone, P.P.; Fuzzy Systems, 1992., IEEE International Conference on , Mar. 8–12, 1992, pp.: 179–188.*

Fuzzy logic controllers: from development to deployment Bonissone, P.P.; Chiang, K.H.; Neural Networks, 1993., IEEE International Conference on , Mar. 28–Apr. 1, 1993, pp.: 610–619 vol. 1.*

Genetic algorithms for automated tuning of fuzzy controllers: a transportation application Bonissone, P.P.; Khedkar, P.S.; Chen, Y.; Fuzzy Systems, 1996., Proceedings of the Fifth IEEE International Conference on , vol.: 1 , 1996 pp.: 674–680□□.*

Industrial applications of fuzzy logic at General Electric Bonissone, P.P.; Badami, V.; Chiang, K.H.; Khedkar, P.S.; Marcelle, K.W.; Schutten, M.J.; Proceedings of the IEEE , vol.: 83 , Issue: 3 , Mar. 1995 pp.: 450–465.*

An antislipping fuzzy logic controller for a railway traction system Garcia–Rivera, M.; Sanz, R.; Perez–Rodriguez, J.A.; Fuzzy Systems, 1997., Proceedings of the Sixth IEEE International Conference on , vol.: 1 , Jul. 1–5, 1997 pp.: 119–124 vol. 1.*

* cited by examiner

*Primary Examiner*—Anil Khatri
*Assistant Examiner*—Michael B. Holmes
(74) *Attorney, Agent, or Firm*—David C. Goldman; Patrick K. Patnode

(57) ABSTRACT

An automatic train handling controller. In one embodiment, there is disclosed a system and method for tracking a velocity profile in a rail-based transportation system. A fuzzy logic controller is used to ensure that a train simulator complies to the velocity profile over a specified track profile while providing a smooth ride. A safety constraint enforcer is used to minimize sudden slack movements by ensuring that the control action provided by the fuzzy logic controller is kept in compliance with a set of predetermined safety constraints. In a second embodiment, there is an automatic train handling controller that smoothly manages the slack of the couplers while keeping the train within prescribed speed limits over a varying terrain.

19 Claims, 13 Drawing Sheets

| e: | NH | NM | NL | ZE | PL | PM | PH | Δe |
|---|---|---|---|---|---|---|---|---|
| | ZE | NL | NM | NH | NH | NH | NH | PH |
| | PL | ZE | NL | NM | NM | NM | NH | PM |
| | PM | PL | ZE | NL | NM | NM | NH | PL |
| | PH | PM | PL | ZE | NL | NM | NH | ZE |
| | PH | PM | PM | PL | ZE | NL | NM | NL |
| | PH | PM | PM | PM | PL | ZE | NL | NM |
| | PH | PH | PH | PH | PM | PL | ZE | NH |

| | HU | LU | LE | LD | HD | KN | DI |
|---|---|---|---|---|---|---|---|
| HU | NC | LO | HO | HO | HO | LO | HO |
| LU | LI | NC | LO | HO | HO | NC | HO |
| LE | HI | LI | NC | LO | HO | LI | LO |
| LD | HI | HI | LI | NC | LO | HI | NC |
| HD | HI | HI | HI | LI | NC | HI | LI |
| KN | P | P | P | P | P | P | P |
| DI | P | P | P | P | P | P | P |

| | HU | LU | LE | LD | HD | KN | DI |
|---|---|---|---|---|---|---|---|
| HU | NC | small$\left(\frac{dn}{dt}\right)$ moderate$\left(\frac{db}{dt}\right)$ | small$\left(\frac{dn}{dt}\right)$ big$\left(\frac{db}{dt}\right)$ | small$\left(\frac{dn}{dt}\right)$ big$\left(\frac{db}{dt}\right)$ | small$\left(\frac{dn}{dt}\right)$ big$\left(\frac{db}{dt}\right)$ | small$\left(\frac{dn}{dt}\right)$ moderate$\left(\frac{db}{dt}\right)$ | small$\left(\frac{dn}{dt}\right)$ big$\left(\frac{db}{dt}\right)$ |
| LU | moderate$\left(\frac{dn}{dt}\right)$ small$\left(\frac{db}{dt}\right)$ | NC | small$\left(\frac{dn}{dt}\right)$ moderate$\left(\frac{db}{dt}\right)$ | small$\left(\frac{dn}{dt}\right)$ big$\left(\frac{db}{dt}\right)$ | small$\left(\frac{dn}{dt}\right)$ big$\left(\frac{db}{dt}\right)$ | NC | small$\left(\frac{dn}{dt}\right)$ big$\left(\frac{db}{dt}\right)$ |
| LE | big$\left(\frac{dn}{dt}\right)$ small$\left(\frac{db}{dt}\right)$ | moderate$\left(\frac{dn}{dt}\right)$ small$\left(\frac{db}{dt}\right)$ | NC | small$\left(\frac{dn}{dt}\right)$ moderate$\left(\frac{db}{dt}\right)$ | small$\left(\frac{dn}{dt}\right)$ big$\left(\frac{db}{dt}\right)$ | moderate$\left(\frac{dn}{dt}\right)$ small$\left(\frac{db}{dt}\right)$ | small$\left(\frac{dn}{dt}\right)$ moderate$\left(\frac{db}{dt}\right)$ |
| LD | big$\left(\frac{dn}{dt}\right)$ small$\left(\frac{db}{dt}\right)$ | big$\left(\frac{dn}{dt}\right)$ small$\left(\frac{db}{dt}\right)$ | moderate$\left(\frac{dn}{dt}\right)$ small$\left(\frac{db}{dt}\right)$ | NC | small$\left(\frac{dn}{dt}\right)$ moderate$\left(\frac{db}{dt}\right)$ | big$\left(\frac{dn}{dt}\right)$ small$\left(\frac{db}{dt}\right)$ | NC |
| HD | big$\left(\frac{dn}{dt}\right)$ small$\left(\frac{db}{dt}\right)$ | big$\left(\frac{dn}{dt}\right)$ small$\left(\frac{db}{dt}\right)$ | big$\left(\frac{dn}{dt}\right)$ small$\left(\frac{db}{dt}\right)$ | moderate$\left(\frac{dn}{dt}\right)$ small$\left(\frac{db}{dt}\right)$ | NC | big$\left(\frac{dn}{dt}\right)$ small$\left(\frac{db}{dt}\right)$ | moderate$\left(\frac{dn}{dt}\right)$ small$\left(\frac{db}{dt}\right)$ |
| KN | small$\left(\frac{dn}{dt}\right)$ small$\left(\frac{db}{dt}\right)$ | small$\left(\frac{dn}{dt}\right)$ small$\left(\frac{db}{dt}\right)$ | small$\left(\frac{dn}{dt}\right)$ small$\left(\frac{db}{dt}\right)$ | small$\left(\frac{dn}{dt}\right)$ small$\left(\frac{db}{dt}\right)$ | small$\left(\frac{dn}{dt}\right)$ small$\left(\frac{db}{dt}\right)$ | small$\left(\frac{dn}{dt}\right)$ small$\left(\frac{db}{dt}\right)$ | small$\left(\frac{dn}{dt}\right)$ small$\left(\frac{db}{dt}\right)$ |
| DI | small$\left(\frac{dn}{dt}\right)$ small$\left(\frac{db}{dt}\right)$ | small$\left(\frac{dn}{dt}\right)$ small$\left(\frac{db}{dt}\right)$ | small$\left(\frac{dn}{dt}\right)$ small$\left(\frac{db}{dt}\right)$ | small$\left(\frac{dn}{dt}\right)$ small$\left(\frac{db}{dt}\right)$ | small$\left(\frac{dn}{dt}\right)$ small$\left(\frac{db}{dt}\right)$ | small$\left(\frac{dn}{dt}\right)$ small$\left(\frac{db}{dt}\right)$ | small$\left(\frac{dn}{dt}\right)$ small$\left(\frac{db}{dt}\right)$ |

FIG. 9

AUTOMATIC TRAIN HANDLING CONTROLLER

CROSS REFERENCE TO RELATED APPLICATIONS

This application is a continuation-in-part of U.S. patent application Ser. No. 08/999,202 entitled "An Automatic Train Handling Controller" filed on Dec. 29, 1997.

BACKGROUND OF THE INVENTION

The application relates generally to a rail-based transportation system and more particularly to an automatic train handling controller that smoothly handles the locomotive controls while staying within prescribed speed limits.

A rail-based transportation system such as a freight train typically comprises at least one locomotive and about one hundred rail-cars connected together by inter-car couplers. Most of the couplers that are currently used are connected to the rail-cars by a hydraulically damped spring. Since each of the couplers are connected to a hydraulically damped spring at opposite ends, there is a slack zone that allows the rail-cars to move relative to each other while in motion, allowing the train to change length by as much as 50–100 feet. For example, the slack zone will decrease to zero while the train is traveling downhill and using dynamic braking and will expand to its maximum length while the train is traveling uphill. The amount of movement allowed by the couplers depends on the handling of the locomotive controls. Typically, the couplers are subjected to two types of forces (i.e., static and dynamic) that may lead to breakage of the couplers, the brake pipe that prevents the rail-cars from banging in to each other, and the train. Accordingly, the train operator has to be careful in the handling of the locomotive controls so that these forces are not exceeded. In addition, the train operator has to control the locomotive so that the train travels within prescribed speed limits without excess acceleration and braking. Violation of the prescribed speed limits and excess acceleration and braking may lead to derailments and severe cargo damage. Therefore, it is imperative that the train operator handle the locomotive controls smoothly while staying within the prescribed speed limits.

Currently, most locomotives are equipped with only a very simplistic cruise control that uses a linear Proportional Integral (PI) controller. This type of cruise control can only be used below speeds of 10 mph and is primarily used for uniform loading and yard movement and cannot prescribe a braking action. In addition, this type of PI controller does not take into account the slack or distributed dynamics of the couplers in any manner and is not applicable for extended trains traveling at cruising speeds over a variety of terrain. Accordingly, there is a need for a train handling controller that can smoothly manage the slack of the couplers while keeping the train within prescribed speed limits over a varying terrain.

SUMMARY OF THE INVENTION

In one embodiment, there is disclosed a train handling controller that can smoothly manage the slack of the couplers while keeping the train within prescribed speed limits over a varying terrain. In particular, there is disclosed a system and method for tracking a rail-based transportation velocity profile using fuzzy logic that enables this embodiment to manage slack and comply with a prescribed speed limit. In this invention there is a velocity profiler containing a predetermined velocity profile for operating a rail-based transportation system over a specified track profile. In addition, there is a train simulator for simulating an operation of the rail-based transportation system over the specified track profile. A fuzzy logic controller controls the operation of the train simulator in accordance with the predetermined velocity profile. In particular, the fuzzy logic controller tracks error and change in error between the train simulator operation and the predetermined velocity profile and provides a control action to the train simulator that minimizes the error. A safety constraint enforcer which is coupled to the fuzzy logic controller ensures that the control action provided by the fuzzy logic controller is in compliance with a set of predetermined safety constraints.

In a second embodiment, there is disclosed a train handling controller that can smoothly manage the slack of the couplers while keeping the train within prescribed speed limits over a varying terrain. In particular, there is disclosed a train handling controller for controlling operation of a rail-based transportation system according to a predetermined velocity profile and a specified track profile. The train handling controller comprises a look-ahead error module that is responsive to the rail-based transportation system and the predetermined velocity profile. The look-ahead error module determines the look-ahead error and change in look-ahead error. A fuzzy logic control module coupled to the look-ahead error module provides a train handling control action in response to the look-ahead error and change in look-ahead error. A fuzzy terrain matcher determines the rate of change for changing the train handling control action provided by the fuzzy logic control module according to the terrain in the specified track profile. A control scheduler, responsive to the fuzzy logic control module and the fuzzy terrain matcher, generates a schedule for changing the train handling control action according to the determined rate of change.

DESCRIPTION OF THE DRAWINGS

FIG. 1 shows a schematic of a general-purpose computer system in which a first and second embodiment of this application operates on;

FIG. 9 shows a rule set used to determine a train handling control action;

DETAILED DESCRIPTION OF THE INVENTION

Figure 1:
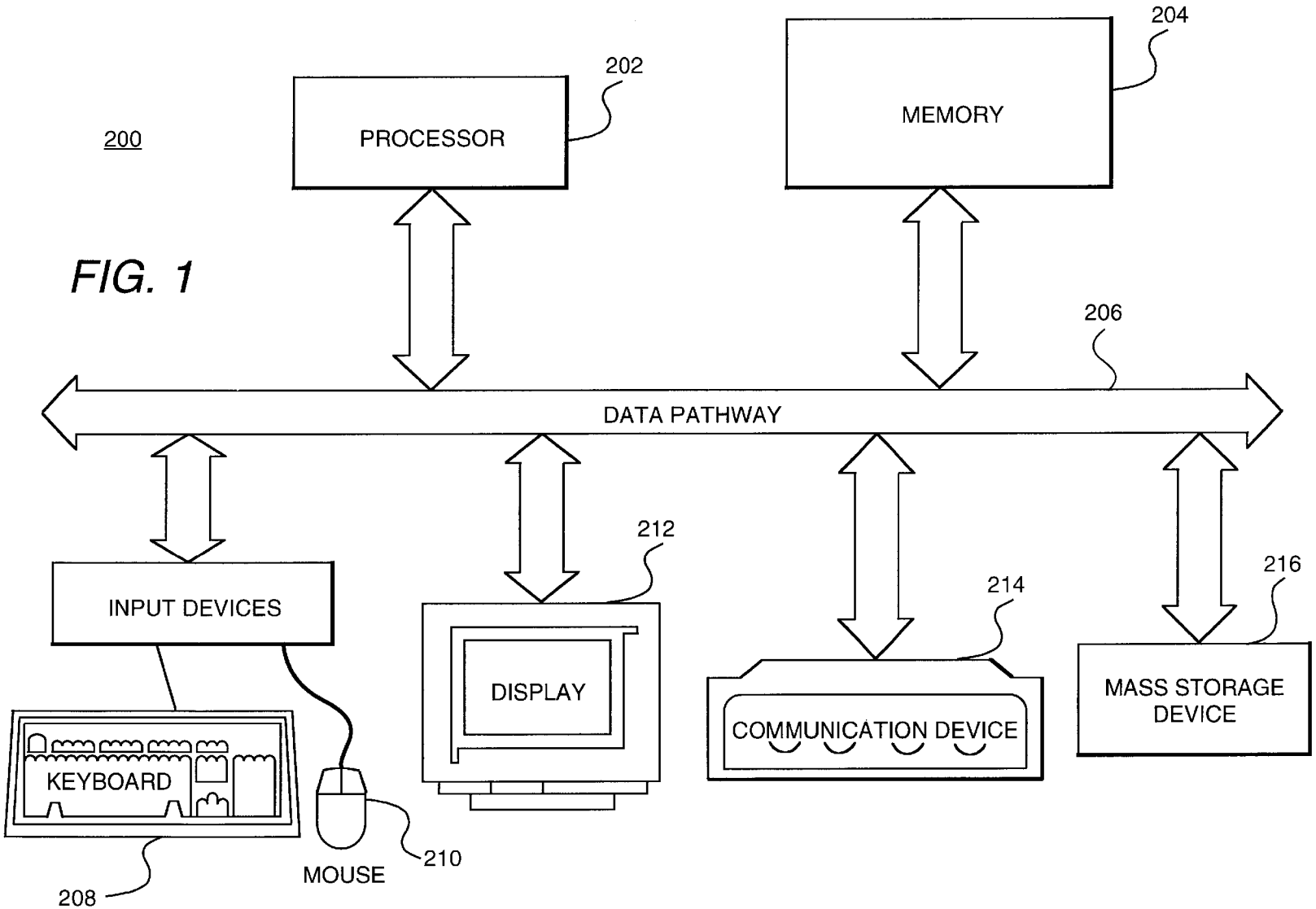

FIG. 1 shows a schematic of a general-purpose computer system 200 in which a first and second embodiment of this application operates on. The computer system 200 generally comprises at least one processor 202, a memory 204, input/output devices, and data pathways (e.g., buses) 206 connecting the processor, memory and input/output devices. The processor 202 accepts instructions and data from the memory 204 and performs various calculations. The processor 202 includes an arithmetic logic unit (ALU) that performs arithmetic and logical operations and a control unit that extracts instructions from memory 204 and decodes and executes them, calling on the ALU when necessary. The memory 204 generally includes a random-access memory (RAM) and a read-only memory (ROM), however, there may be other types of memory such as programmable read-only memory (PROM), erasable programmable read-only memory (EPROM) and electrically erasable programmable read-only memory (EEPROM). Also, the memory 204 preferably contains an operating system, which executes on the processor 202. The operating system performs basic tasks that include recognizing input, sending output to output devices, keeping track of files and directories and controlling various peripheral devices.

The input/output devices may comprise a keyboard 208 and a mouse 210 that enter data and instructions into the computer system 200. A display 212 allows a user to see what the computer has accomplished. Other output devices may include a printer, plotter, synthesizer and speakers. A communication device 214 such as a telephone or cable modem or a network card such as an Ethernet adapter, local area network (LAN) adapter, integrated services digital network (ISDN) adapter, or Digital Subscriber Line (DSL) adapter, that enables the computer system 10 to access other computers and resources on a network such as a LAN or a wide area network (WAN). A mass storage device 216 allows the computer system 200 to permanently retain large amounts of data. The mass storage device may include all types of disk drives such as floppy disks, hard disks and optical disks, as well as tape drives that can read and write data onto a tape that could include digital audio tapes (DAT), digital linear tapes (DLT), or other magnetically coded media. The above-described computer system 10 can take the form of a hand-held digital computer, personal digital assistant computer, personal computer, workstation, minicomputer, mainframe computer or supercomputer.

Figure 2:
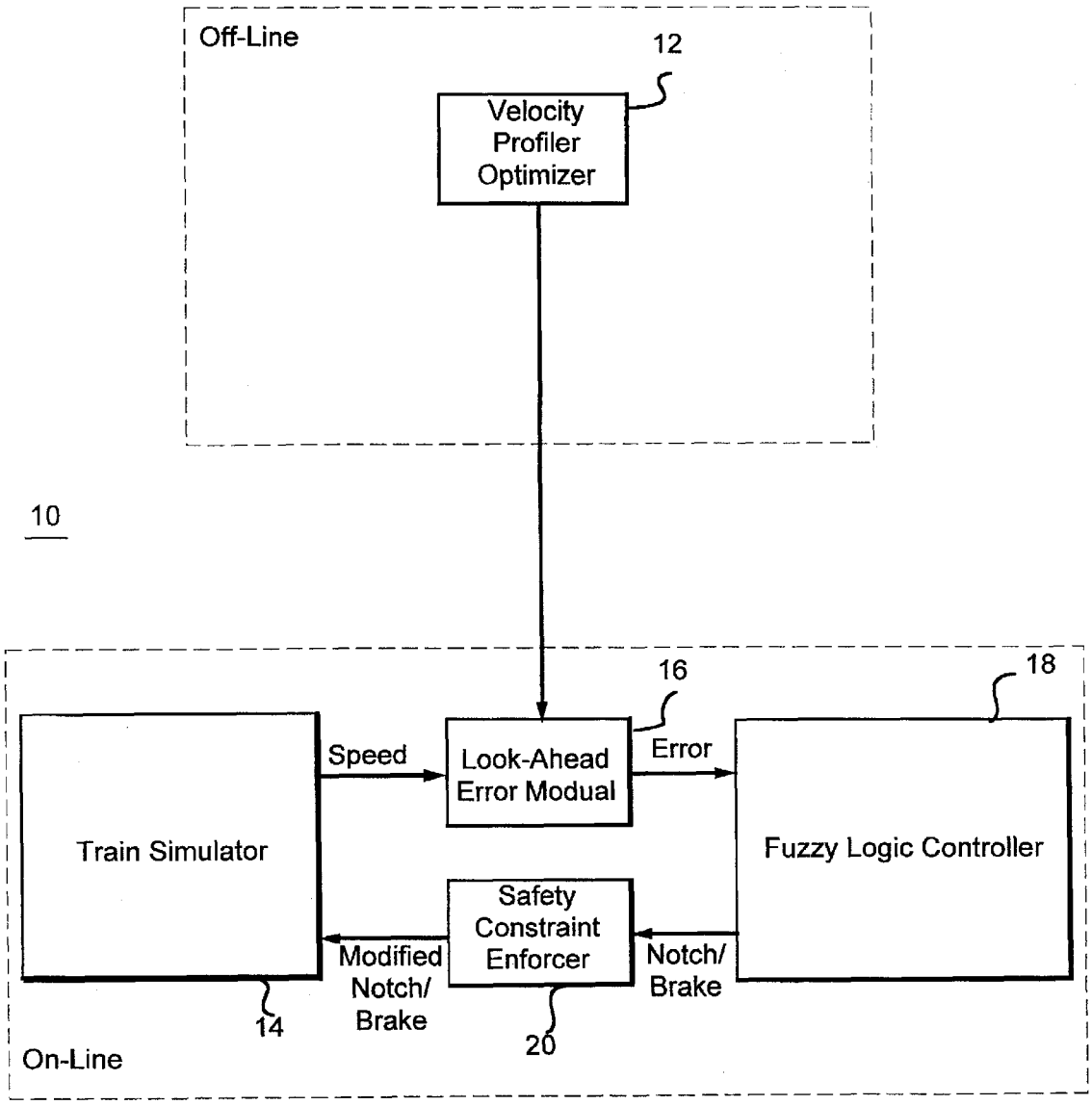
FIG. 2 shows a block diagram of the system for tracking a rail-based transportation velocity profile using fuzzy logic that operates on the computer system shown in FIG. 1 according to the first embodiment.

FIG. 2 shows a block diagram of a system 10 for tracking a rail-based transportation velocity profile using fuzzy logic that operates on the computer system shown in FIG. 1. The system 10 includes a velocity profiler 12 that contains a predetermined velocity profile for operating a rail-based transportation system such as a freight train over a specified track profile. A train simulator 14 is used to simulate the operation of the train over the specified track profile. A look-ahead error module 16 compares the speed of the train simulator 14 at various locations of the specified track profile to the predetermined velocity profile that is stored within the velocity profiler 12 to determine the current error. In addition, the look-ahead error module 16 predicts the future velocity of the train simulator and uses it to determine the future error or the look-ahead error of the train. The look-ahead error module 16 sends an error signal corresponding to the look-ahead error between the speed of the train simulator 14 and the predetermined velocity profile. A fuzzy logic controller 18 tracks the look-ahead error and change in look-ahead error to generate a control action to the train simulator 14 that minimizes the look-ahead error. In this invention, the control action is the modification of the throttle notch, dynamic brake, and air brake settings. A safety constraint enforcer 20 which is coupled to the fuzzy logic controller 18 modifies the control action provided by the fuzzy logic controller in order to ensure that the control action is in compliance with a set of predetermined safety constraints.

The velocity profiler 12, the train simulator 14, the look-ahead error module 16, the fuzzy logic controller 18 and the safety constraint enforcer are preferably implemented in software, however, these components can be implemented in firmware or hardware. For example, the fuzzy logic controller 18 can be implemented in hardware using standard hardware (e.g., digital signal processing) or customized application specific integrated circuits (e.g., SThompson chips). Alternatively, the above components may be implemented in combinations of software, hardware or firmware.

The velocity profiler 12 comprises a track profile of several different tracks. The track profile includes the grade of the track, the elevation of the track, the curvature of the track, the speed limits, as well as any landmarks, the grade crossings, bridges and so forth. In addition, the velocity profiler 12 comprises a train makeup of the train and locomotive characteristics. The train makeup includes the number of rail-cars, the type of rail-cars, the position and lading of each rail-car, and the type of each locomotive in the consist. A train dynamics model uses the track profile and train makeup information to generate the acceleration of the train from a locomotive tractive or braking force, grade forces on the train, and resistance forces due to aerodynamic drag, track curvature, and wheel rail friction. An optimization algorithm optimizes the train dynamics model to find the function of the tractive effort versus position or time that results in the completion of the journey in a specified time with minimized fuel consumption. The result of the optimization algorithm is the optimal velocity profile for operating the train over the specified track profile.

The train simulator 14 simulates the operation of the train based on three inputs, the locomotive characteristics, the train makeup and the track profile. The locomotive characteristics specify the tractive/braking effort available at a given velocity and notch setting. The locomotive characteristics also contains a specific fuel consumption table which are specific to each make of locomotive and can be varied suitably. The train makeup is comprised of a list of rail-cars and/or locomotives, arranged in sequential order within the train. The type of the car and the amount of lading has to be specified for each car. The empty weight and other physical characteristics of the rail-car such as cross-sectional area, Davis coefficients etc. are inferred from the car type, and are maintained in a separate database. The track profile comprises a list of mileposts along the specified track, with the distance from the starting point, the current grade in percent, curvature in degrees, and the speed limit in mph. The beginning and end of the journey is marked either by special milepost designations or by a speed limit of zero. The train simulator uses the above-noted inputs to generate outputs such as time in minutes, the throttle notch setting having a range from 0–8, the dynamic brake setting having a range from 0–8, the air brake setting in psi, the distance traveled in miles, the velocity in mph, the net acceleration in mph/min, the total cumulative fuel consumed in gallons, the net elevation in miles, the tractive effort in lb-ft, the total braking effort (dynamic+air) in lb-ft, the air brake effort in lb-ft, and the reference velocity in mph. This list of outputs is only illustrative of the possibilities and this invention is not limited thereto.

As mentioned above, the error look-ahead module 16 compares the speed of the train simulator 14 to the predetermined velocity as defined by the velocity profiler 12 to determine the current error. The current error e(s) is defined as:

$$e(s)=v(s)-v^*(s), \tag{1}$$

wherein v*(s) is the desired velocity at a point s along the trajectory of the velocity profile and v(s) is the actual current velocity at point s. In addition, the look-ahead error module 16 predicts the future velocity of the train simulator and uses it to determine the look-ahead error. The look-ahead error ê is defined as:

$$\hat{e}(s)=\sum_{i=0}^{l/\Delta s}(\hat{v}(s+i\Delta s)-v*(s+i\Delta s))\alpha^i, \tag{2}$$

wherein v̂( ) is the projected velocity over a look-ahead distance l from the current position s as provided by the velocity profiler 12 and i is an index. In equation 2, the projected look-ahead errors are discounted by an exponentially decreasing weight such that an error over an incremental distance Δs further into the future is α times less important for tracking the profile. Thus, the incremental distance Δs and the weighting constant α together control the importance given to future tracking versus current tracking. In this invention, the look-ahead length l is nominally taken to be the length of the given train. In typical cases, the look-ahead length l may range between 1–2 miles, the incremental distance Δs equals 0.2 and the weighting constant α ranges from 0.1 to 0.9. In order to normalize the scale for error, it is desirable to normalize equation 2 such that the look-ahead error ê is defined as:

$$\hat{e}(s)=\sum_{i=0}^{l/\Delta s}(\hat{v}(s+i\Delta s)-v*(s+i\Delta s))\frac{\alpha^i}{\sum_j \alpha^j}, \tag{3}$$

wherein j is an index.

In equation 2, the projected velocity at any point Δs miles from the current position s is defined as:

$$\hat{v}(s+\Delta s)=\sqrt{v^2(s)+2\cdot\alpha(s)\cdot\Delta s}, \tag{4}$$

wherein a(s) is the current acceleration of the train. This is an approximation since it assumes a constant acceleration over the look-ahead distance l. It is believed that this approximation may be a reasonable one for almost all of the train's journey, especially when it is in a negotiating mode, since acceleration changes are done gradually. On the other hand, this approximation may be too simplistic for fine control where the terrain has a significant effect.

In cases where the terrain does have a significant effect, a new computation of the look-ahead acceleration needs to be derived to take into account the difference of the grade force acting on the train between current and future terrain as provided by the specified track profile in the train simulator 14. In these cases, it is assumed that the train is a single block so that the slack motion is not taken into consideration. Therefore, the total force acting on the train $F_{total}$ is defined as:

$$F_{total}=F_t-F_b-F_r-F_g, \tag{5}$$

wherein $F_t$ and $F_b$ are the tractive and braking efforts, respectively, $F_r$ is the friction force, and $F_g$ is the grade force. In this application, $F_t$, $F_b$ and $F_r$ are assumed to remain constant over a look-ahead distance. This is a reasonable approximation since $F_r$ is mainly a function of the train's velocity and it changes gradually due to its massive inertia. Thus, the total force acting on the train $F_{total}$ can be defined as:

$$F_{total}=F_{constant}-F_g \tag{6}$$

Using the equation of motion, the projected acceleration â at any point Δs from the current position s results in:

$$\hat{a}(s+\Delta s)=a(s)-\frac{\hat{F}_g(s+\Delta s)-F_g(s)}{m}, \tag{7}$$

wherein a(s) and $F_g(s)$ are the current acceleration and grade force, respectively, m is the inertia, and â(s+Δs) and $\hat{F}_g(s+\Delta s)$ are the projected acceleration and grade force, respectively. Therefore, the projected velocity at any point Δs miles from the current position s is defined as:

$$\hat{v}(s+\Delta s)=\sqrt{v^2(s)+2\cdot\hat{a}(s+\Delta s)\cdot\Delta s}, \tag{8}$$

wherein v(s) is the current velocity of the train.

Figure 3:
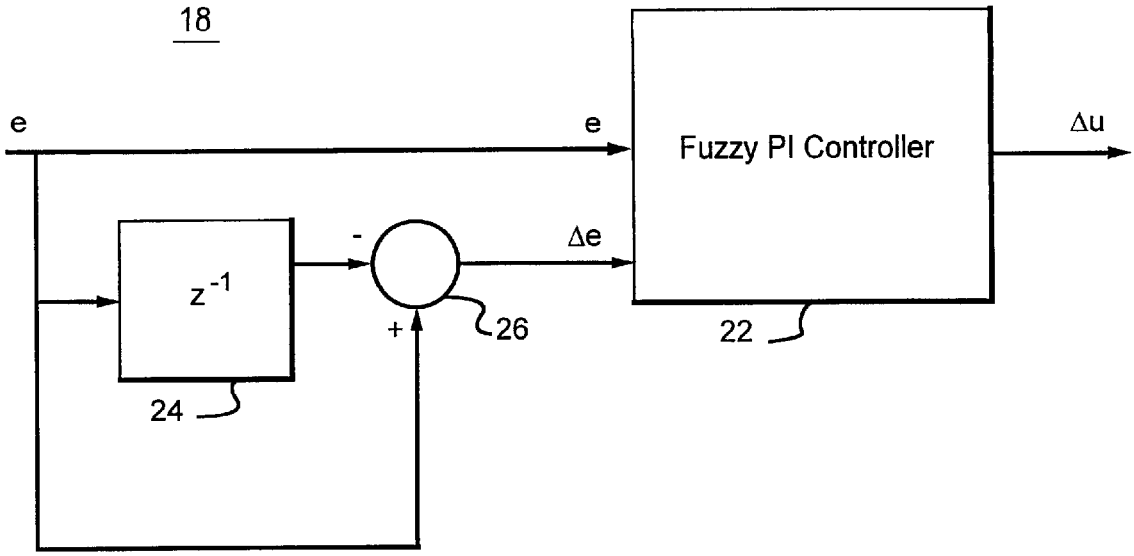
FIG. 3 shows a block diagram of a more detailed view of the fuzzy logic controller shown in FIG. 2.
Figure 4:
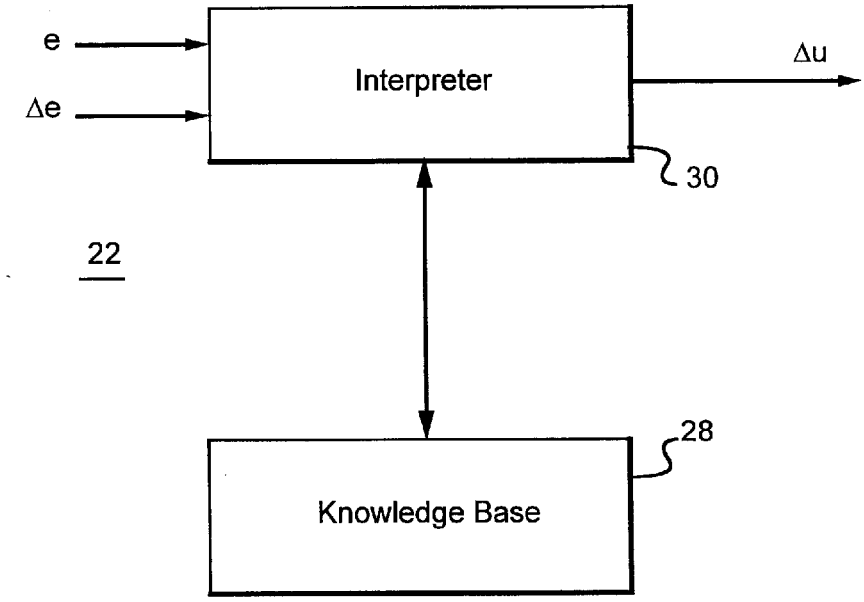
FIG. 4 shows a block diagram of a more detailed view of the fuzzy logic PI controller shown in FIG. 1.

As mentioned above, the fuzzy logic controller 18 uses the look-ahead error and change in look-ahead error to generate a control action to the train simulator 14 that minimizes the look-ahead error. FIG. 3 shows a block diagram of a more detailed view of the fuzzy logic controller 18. The fuzzy logic controller 18 comprises a fuzzy logic PI controller 22 that receives the look-ahead error e determined by the look-ahead module 16 and change in look-ahead error Δe as determined by a delay element (i.e., a sample and hold) 24 and a summer 26 to generate incremental control actions Δu. The fuzzy logic PI controller as shown in FIG. 4 comprises a knowledge base 28 having a rule set, term sets, and scaling factors. The rule set maps linguistic descriptions of state vectors such as e and Δe into the incremental control actions Δu; the term sets define the semantics of the linguistic values used in the rule sets; and the scaling factors determine the extremes of the numerical range of values for both the input (i.e., e and Δe) and the output (i.e., Δu) variables. An interpreter 30 is used to relate the error e and the change in error Δe to the control action Δu according to the scaling factors, term sets, and rule sets in the knowledge base 28.

Each of the input variables (e and Δe) and the output variable (Δu) have a term set. The term sets are separated into sets of NH, NM, NL, ZE, PL, PM, PH, wherein N is negative, P is positive, H is high, M is medium, L is low, and ZE is zero. Accordingly, NH is negative high, NM is negative medium, NL is negative low, PL is positive low, PM is positive medium, and PH is positive high. Those skilled in the art will realize that there are other term sets that can be used. Each term set has a corresponding membership function that returns the degree of membership or belief, for a given value of the variable. Membership functions may be of any form, as long as the value that is returned is in the range of [0,1]. Initially, the terms are uniformly positioned trapezoids overlapping at a 50% level over the normalized universe of discourse as shown in FIG. 5.

Figures 5, 6:
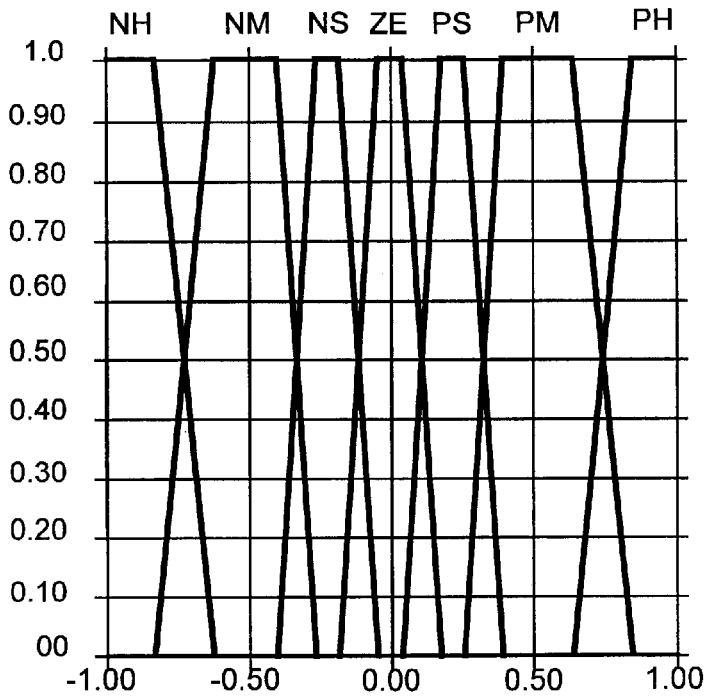
FIG. 5 shows an example of a fuzzy membership function used for the fuzzy logic PI controller.
FIG. 6 shows an example of a rule set for the fuzzy logic PI controller.

An example of a rule set for the fuzzy logic PI controller 22 is shown in FIG. 6. As mentioned above, the rule set maps linguistic descriptions of the error e and the change in error Δe into the control action Δu. In FIG. 6, if e is NH and Δe is PH, then Δu will be ZE. Another example is if e is PL and Δe is NH, then Δu will be PM. Those skilled in the art will realize that there are other rule sets that can be used.

The relationship between the output variable u and the input variable e in the fuzzy logic PI controller 22 is expressed approximately as:

$$\frac{\Delta u(t)}{S_u} \approx \frac{\Delta e(t)}{S_d} + \frac{e(t)}{S_e}, \tag{9}$$

$$u(t) \approx \frac{S_u}{S_d} \cdot e(t) + \frac{S_u}{S_e} \cdot \int e(t), \tag{10}$$

$$-S_e \leqq e(t) \leqq S_e, \tag{11}$$

$$-S_d \leqq \Delta e(t) \leqq S_d, \tag{12}$$

$$-S_u \leqq \Delta u(t) \leqq S, \tag{13}$$

wherein $S_e$, $S_d$, $S_u$, are the scaling factors of the error e, the change of error Δe, and the incremental output variable Δu, respectively. The above relationship differs from a conventional PI controller which is defined as:

$$u(t)=K_p e(t)+K_i \int e(t)dt, \tag{14}$$

wherein $K_p$ and $K_i$ are the proportional and integral gain factors, respectively. Comparing the fuzzy logic PI controller of this application with the conventional PI controller results in the following:

$$K_p \approx \frac{S_u}{S_d} \text{ and } K_i \approx \frac{S_u}{S_e} \cdot \left(\frac{1}{dt}\right) \tag{15}$$

Figures 7, 8:
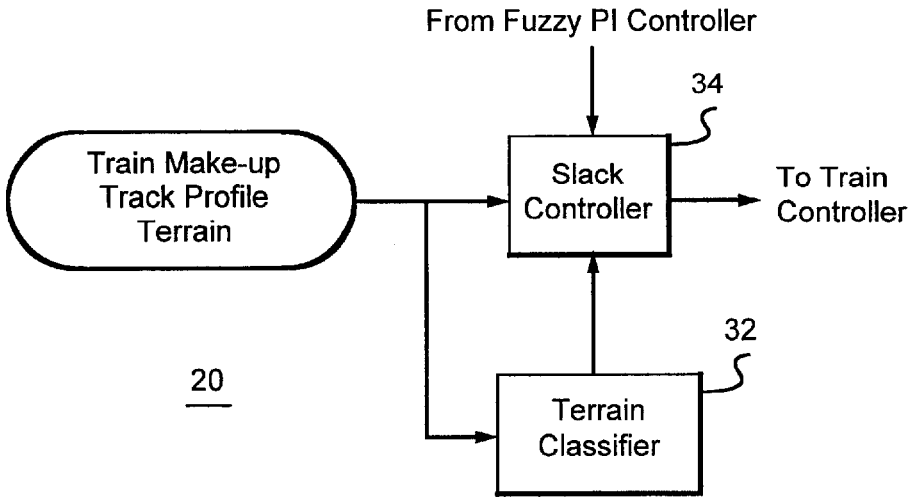
FIG. 7 shows a block diagram of a more detailed view of the safety constraint enforcer shown in FIG. 2.
FIG. 8 shows a rule set for determining the slack tendency.

As mentioned above, the safety constraint enforcer 20 modifies the control action provided by the fuzzy logic controller in order to ensure that the control action is in compliance with a set of predetermined safety constraints. FIG. 7 shows a block diagram of a more detailed view of the safety constraint enforcer 20. The safety constraint enforcer comprises a terrain classifier 32 for classifying the terrain to be traveled by the train throughout its journey. In particular, the terrain classifier determines the grade value at each position along the track profile. The terrain in a track profile are classified as one of seven classifications. The terrain classifications are heavy up, light up, level, light down, heavy down, dip, and knoll. Each terrain classification is based on the grade g for a set of mileposts in a specific track. A milepost is located at a given distance on a track and the grade, curvature, and speed limit at that milepost are considered to be valid until the next milepost. The terrain classifications according to the grade g are as follows:

$$\text{heavy up: } \min(g) \geqq 1.0, \tag{16}$$

$$\text{light up: } \max(g) < 1.0 \text{ and } \min(g) > 0.25, \tag{17}$$

$$\text{level: } \max(g) \leqq 0.25 \text{ and } \min(g) \geqq -0.25, \tag{18}$$

$$\text{light down: } \max(g) < -0.25 \text{ and } \min(g) > -1.0, \tag{19}$$

$$\text{heavy down: } \max(g) \geqq -1.0, \tag{20}$$

$$\text{dip: } \min(g) \leqq -0.25 \text{ and } \max(g) > 0.1 \text{ and } \min(x) < \max(x), \tag{21}$$

$$\text{knoll: } \max(g) > 0.25 \text{ and } \min(g) < -0.1 \text{ and } \max(x) < \min(x), \tag{22}$$

wherein max(g) and min(g) are the maximum and minimum values of the grade value, respectively.

The above terrain classifications are then used by a slack controller 34 to provide a train handling control action. First, the slack controller 34 uses the current terrain and the future terrain to estimate the slack tendency behavior for the train at a particular location along the track. The estimated slack tendency is based on fuzzy rules that have been formulated for the current terrain and the future terrain. Each fuzzy rule is in the following form:

$$\text{If } C_i \text{ AND } F_i \text{ THEN } S_j, \tag{23}$$

wherein $C_i$ is the current terrain, $F_i$ is the future terrain, and $S_j$ is the slack tendency. Both the current terrain $C_i$ and the future terrain $F_i$ refer to one of the above-noted seven terrain types (i.e., heavy up, light up, level, light down, heavy down, dip and knoll). The term set for the slack tendency $S_j$ are separated into sets of NC, LI, HI, LO, HO, and P wherein NC means no change, LI means light run-in, HI means heavy run-in, LO means light run-out, HO means heavy run-out, and P is partial run-in and partial run-out. Run-in means that the slack zone tends to decrease and run-out means that the slack zone tends to increase. The rule set that is used by the slack controller to estimate the slack tendency is shown in FIG. 8. The rule set maps linguistic descriptions of the current terrain $C_i$ and the future terrain $F_i$ into the slack tendency $S_j$. In FIG. 8, if $C_j$ is HU and $F_j$ is LD, then $S_j$ will be HO. Another example is if $C_j$ is KN and $F_j$ is DI, then $S_j$ will be P.

Once the slack tendency has been determined, then the slack controller 34 uses the estimated slack tendency to provide a train handling control action. The train handling control action is dependent on the type of terrain. For example, while a train negotiates on a level or up terrain, the train is generally able to maintain a balanced speed by varying the throttle one or two notches. For negotiating on a down terrain, it is necessary to determine the proper braking method. In this invention there are three braking methods. The first type is the slack bunched method where only the dynamic brakes are used. In this method, the throttle is reduced to an idle and after waiting at least 10 seconds then the dynamic brakes are applied. The second type is the slack bunched method where both the dynamic and air brakes are used. In this method, the dynamic brakes are applied to about one third to three-quarter of their total capacity and the air brakes are applied so that there is a reduction in the range of five to eight psi. In addition, the air brakes are applied to two to three psi or the total air brake reduction is at least 10 psi. Afterwards, the air brakes and dynamic brakes are released after speed reduction has been reached.

The third type is the modified slack bunched method where only the air brakes are used. In this method, the throttle is reduced and the air brakes are applied so that there is a reduction in the range of five to eight psi. In addition, the air brakes are applied to two to three psi or until the total air brake reduction is at least 10 psi. The air brakes are then released after speed reduction has been reached. For a train traveling in a dip or a knoll, there is a strong tendency to have heavy slack motion. In order to prevent the heavy slack motion in a dip or knoll this invention throttles up while traveling uphill and throttles down while traveling downhill. The throttle up or throttle down is then resumed for the dip or knoll, respectively. As a train crests a grade, the throttle is reduced and then one of the above braking methods are selected.

These considerations are taken into account by the train handling control actions and have been formulated into fuzzy rules. Each fuzzy rule is in the following form:

$$\text{If } C_i \text{ AND } F_i \text{ THEN } A_j, \tag{24}$$

wherein $C_i$ is the current terrain, $F_i$ is the future terrain, and $A_j$ is the train handling control action. Both the current terrain $C_i$ and the future terrain $F_i$ refer to one of the above-noted seven terrain types (i.e., heavy up, light up, level, light down, heavy down, dip and knoll). The train handling control action $A_j$ refers to one of the five following action constraints:

- light throttle up to reduce the effect of light slack run in;
- heavy throttle up to reduce the effect of heavy slack run-in;
- heavy throttle up to reduce the effect of heavy slack run-in;
- light throttle down to reduce the effect of light slack run-out;
- heavy throttle down to reduce the effect of heavy slack run-out; and
- conservative when encountering partial slack run-in and partial slack run-out.

For each one of these five action constraints there is a corresponding train handling control action $A_j$ to be followed. For instance, if the constraint is to use a light throttle up to reduce the effect of light slack run-in, then the control action $A_j$ is to use a moderate $$\left(\frac{dn}{dt}\right)$$

and a small $$\left(\frac{db}{dt}\right),$$

where $$\left(\frac{dn}{dt}\right)$$

represents the rate of notch change and $$\left(\frac{db}{dt}\right)$$

represents the rate of dynamic brake change. If the constraint is to use a heavy throttle up to reduce the effect of heavy slack run-in, then the control action $A_j$ is to use a big $$\left(\frac{dn}{dt}\right)$$

and a small $$\left(\frac{db}{dt}\right).$$

If the constraint is to use light throttle down to reduce the effect of light slack run-out, then the control action $A_j$ is to use a small $$\left(\frac{dn}{dt}\right)$$

and a moderate $$\left(\frac{db}{dt}\right).$$

If the constraint is to use a heavy throttle down to reduce the effect of heavy slack run-out, then the control action $A_j$ is to use a small $$\left(\frac{dn}{dt}\right)$$

and a big $$\left(\frac{db}{dt}\right).$$

If the constraint is to be conservative when encountering partial slack run-in and partial slack run-out, then the control action $A_j$ is to use a small $$\left(\frac{dn}{dt}\right)$$

and a small $$\left(\frac{db}{dt}\right).$$

The rule set used to determine a train handling control action is shown in FIG. 9. The rule set maps linguistic descriptions of the current terrain $C_i$ and the future terrain $F_i$ into the control action $A_j$. In FIG. 9, if $C_j$ is HU and $F_j$ is LD, then $A_j$ will be a small $$\left(\frac{dn}{dt}\right)$$

and a big $$\left(\frac{db}{dt}\right).$$

Another example is if $C_j$ is KN and $F_j$ is DI, then $S_j$ will be a small $$\left(\frac{dn}{dt}\right)$$

and a small $$\left(\frac{db}{dt}\right).$$

Figure 10:
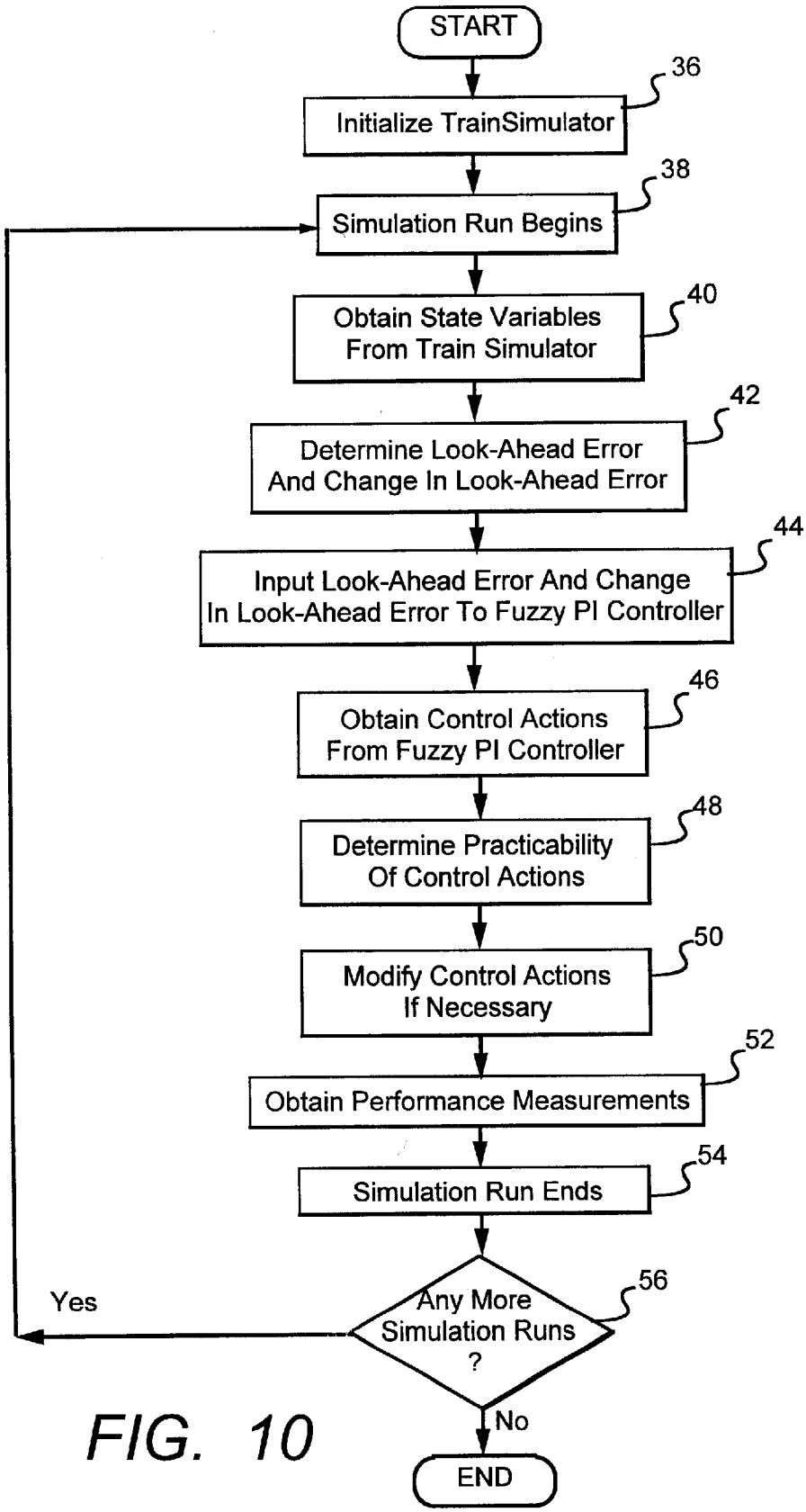
FIG. 10 shows a flow chart setting forth the operations performed according to the first embodiment.

FIG. 10 shows a flow chart setting forth the operations of the first embodiment. The train simulator 14 is first initialized for a journey over a specified track profile at 36. Next, a simulation run is begun at 38. At each simulator run, state variables are obtained from the train simulator at 40. In this embodiment, the state variables are the speed of the train simulator and the position of the simulator with respect to the specified track profile. The state variables are then inputted to the look-ahead error module at 42 to obtain the look-ahead error and the change in look-ahead error. Then both the look-ahead error and the change in look-ahead error are inputted to the fuzzy logic PI controller at 44. The fuzzy logic PI controller uses the inputted look-ahead error and change in look-ahead error to recommend a control action (i.e., a change in the throttle notch and braking settings) at 46. The control action is then sent to the safety constraint enforcer 20 where the slack tendency is estimated and the safety constraint enforcer are used to determine the practicability of the control action at 48 so that the rate of change of the control action can be adjusted appropriately at 50. Performance measurements of the train simulator 14 such as the fuel usage, the tracking of the look-ahead error, and throttle notch jockeying are then obtained at 52 and stored in a log. The simulation run then ends at 54. If it is determined that there are more simulation runs left in the journey at 56, then processing steps 38–54 are continued until there are no longer any more simulation runs.

Figure 11:
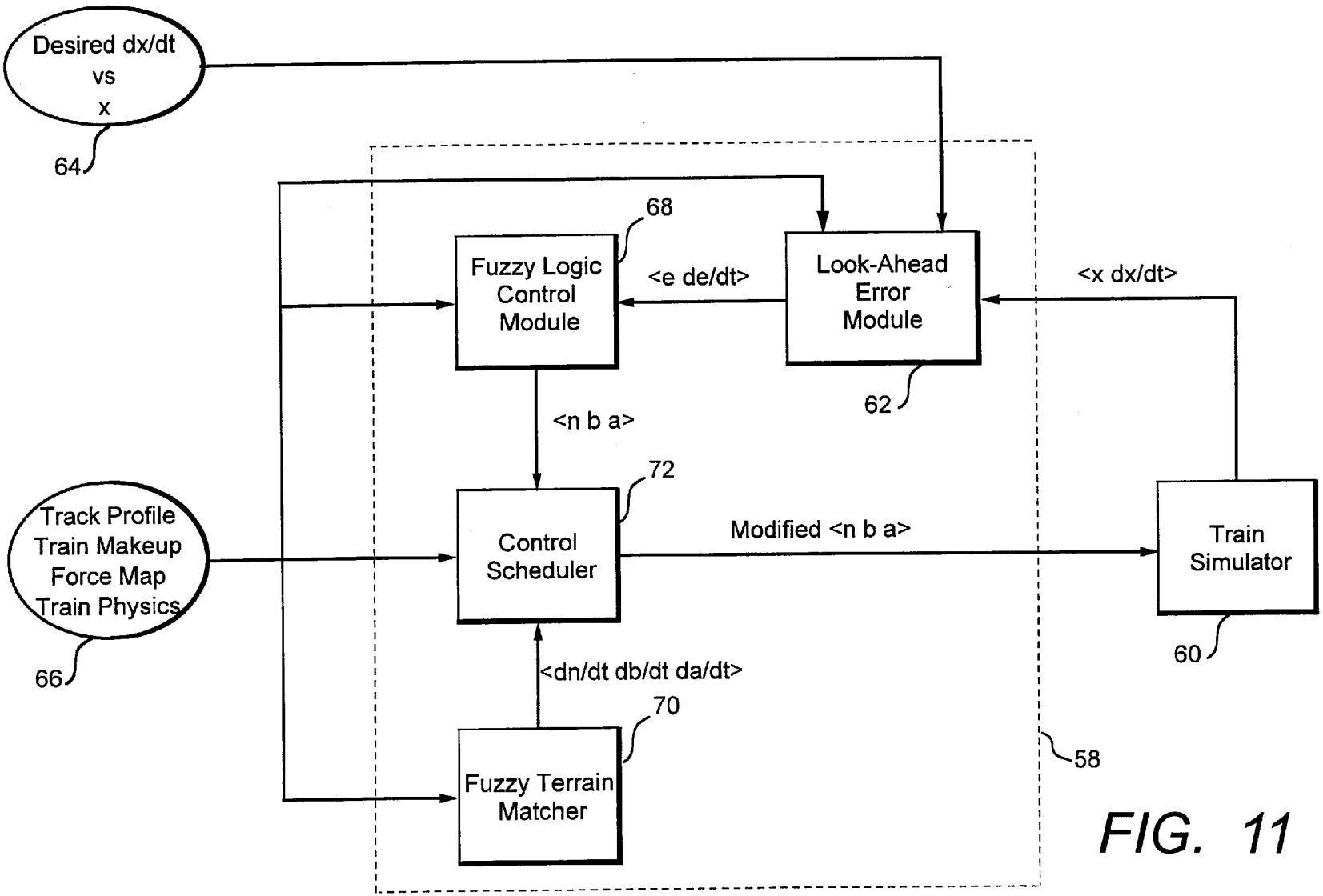
FIG. 11 shows a block diagram of an automatic train handling controller that operates on the computer system shown in FIG. 1 according to the second embodiment.

FIG. 11 shows a block diagram of an automatic train handling controller 58 for controlling the operation of a rail-based transportation system such as a freight train according to a predetermined velocity profile and a specified track profile that operates on the computer system shown in FIG. 1. In this embodiment, operation of the rail-based transportation system is simulated by a train simulator 60. The train handling controller 58 includes a look-ahead error module 62 that is responsive to the train simulator 60 and the predetermined velocity profile 64. The predetermined velocity profile is generated by a velocity profiler such as the one described earlier with reference to FIG. 2. The predetermined velocity profile such as the desired velocity dx/dt for a particular position x along the track profile is inputted to the look-ahead error module 62 along with other inputs 66 such as a track profile, train makeup, force map, and train physics information. In addition, the velocity dx/dt and position x of the simulated train operation is sent from the train simulator 60 and inputted to the look-ahead error module 62. The look-ahead error module 62 determines the future error or look-ahead error e and change in look-ahead error de/dt. The look-ahead error module 62 uses the velocity dx/dt and position x inputs from the train simulator 60 to predict the future velocity of the simulator. The look-ahead error module 62 then uses the predicted future velocity to determine the look-ahead error e and the change in look-ahead error de/dt. All of the computations performed by the look-ahead error module are done in the same manner as described earlier for the first embodiment.

A fuzzy logic control module 68 tracks the look-ahead error e and change in look-ahead error de/dt to generate a control action that minimizes the look-ahead error. In this embodiment, the control action is the modification of the throttle notch setting n, the dynamic brake setting b and the air brake a setting. A fuzzy terrain matcher 70 determines the rate of change (i.e., dn/dt, db/dt, da/dt) for changing the train handling control action provided by the fuzzy logic control module according to the terrain of the specified track profile. A control scheduler 72 uses the train handling control action generated from the fuzzy control module 68 and the rate of change of control action that was determined by the fuzzy terrain matcher 70 to generate a schedule for smoothly changing the train handling controls (i.e., the notch, dynamic brake, and air brake).

In this embodiment, the train simulator 60 simulates the operation of the train based on three inputs, the locomotive characteristics, the train makeup and the track profile. The locomotive characteristics specify the tractive/braking effort available at a given velocity and notch setting. The locomotive characteristics also contains a specific fuel consumption table which are specific to each make of locomotive and can be varied suitably. The train makeup is comprised of a list of rail-cars and/or locomotives, arranged in sequential order within the train. The type of the car and the amount of lading has to be specified for each car. The empty weight and other physical characteristics of the rail-car such as cross-sectional area, Davis coefficients etc. are inferred from the car type, and are maintained in a separate database. The track profile comprises a list of mileposts along the specified track, with the distance from the starting point, the current grade in percent, curvature in degrees, and the speed limit in mph. The beginning and end of the journey is marked either by special milepost designations or by a speed limit of zero. The train simulator 60 uses the above-noted inputs to generate outputs such as time in minutes, the throttle notch setting having a range from 0–8, the dynamic brake setting having a range from 0–8, the air brake setting in psi, the distance traveled in miles, the velocity in mph, the net acceleration in mph/min, the total cumulative fuel consumed in gallons, the net elevation in miles, the tractive effort in lb-ft, the total braking effort (dynamic+air) in lb-ft, the air brake effort in lb-ft, and the reference velocity in mph. This list of outputs is only illustrative of the possibilities and this invention is not limited thereto.

Figure 12:
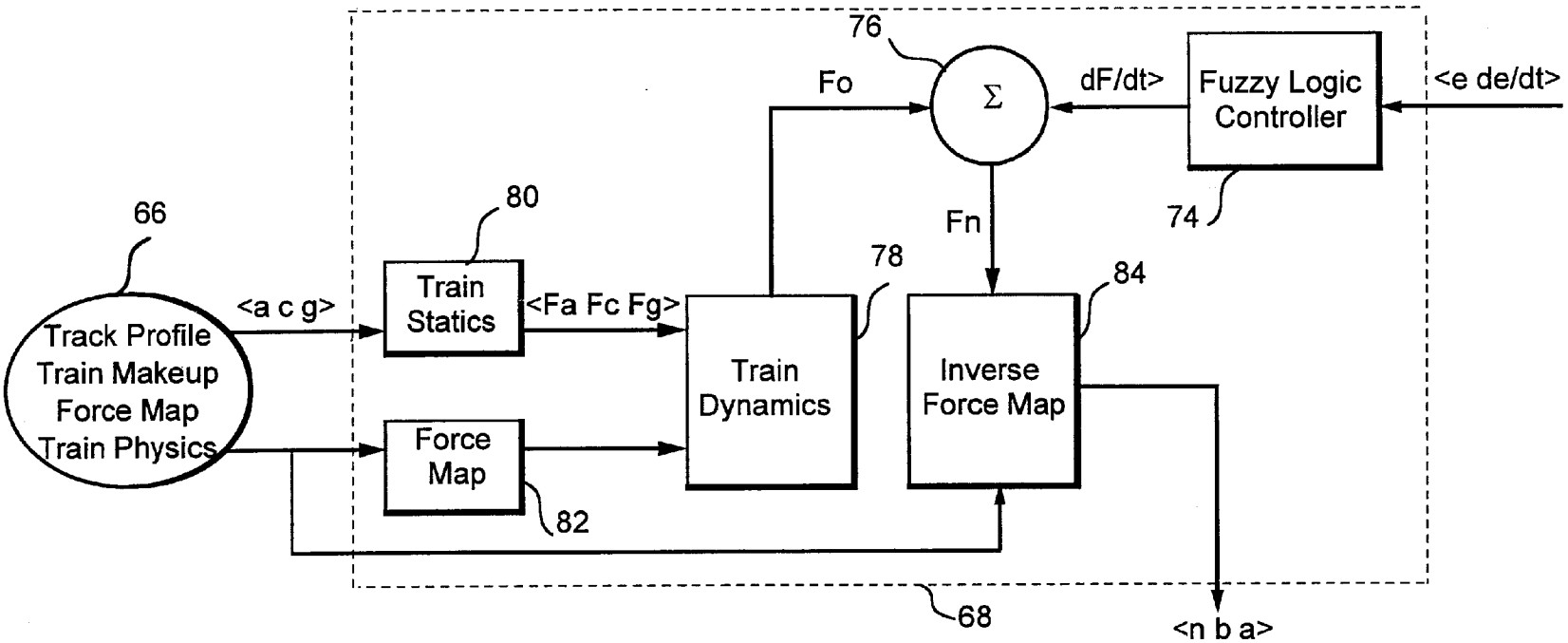
FIG. 12 shows a block diagram of a more detailed view of the fuzzy logic control module shown in FIG. 10.

As mentioned above, the fuzzy logic control module 68 tracks the look-ahead error e and change in look-ahead error de/dt to generate a control action (i.e. modification of the throttle notch setting n, the dynamic brake setting b and the air brake a setting) that minimizes the look-ahead error. FIG. 12 shows a block diagram of a more detailed view of the fuzzy logic control module 68. The fuzzy logic control module 68 includes a fuzzy logic controller 74 that receives the look-ahead error e and change in look-ahead error de/dt from the look-ahead module 62 and generates a recommended incremental change in the force dF/dt to be exerted by the locomotive for the next time step. The fuzzy logic controller 74 is similar to the fuzzy logic controller 18 described earlier with reference to FIG. 2. In particular, the fuzzy logic controller comprises a knowledge base having a rule set, term sets, and scaling factors. The rule set maps linguistic descriptions of state vectors such as e and de/dt into the incremental control actions dF/dt; the term sets define the semantics of the linguistic values used in the rule sets; and the scaling factors determine the extremes of the numerical range of values for both the input (i.e., e and de/dt) and the output (i.e., dF/dt) variables. An interpreter is used to relate the error e and the change in error de/dt to the control action dF/dt according to the scaling factors, term sets, and rule sets in the knowledge base.

Figure 13A:
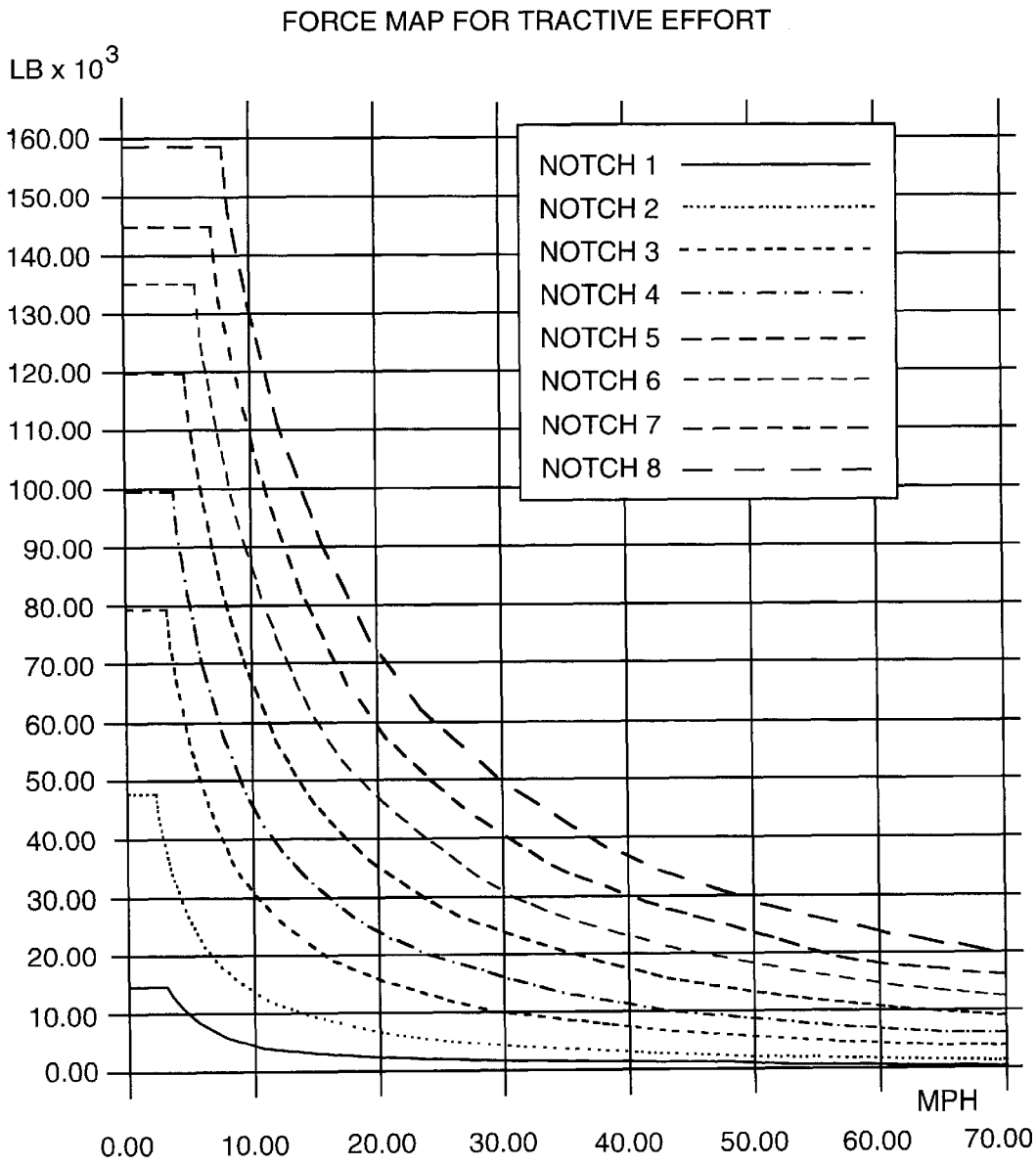
FIGS. 13*a*–13*b* show examples of force maps used for determining the tractive forces and the dynamic braking forces acting on a train, respectively.
Figure 13B:
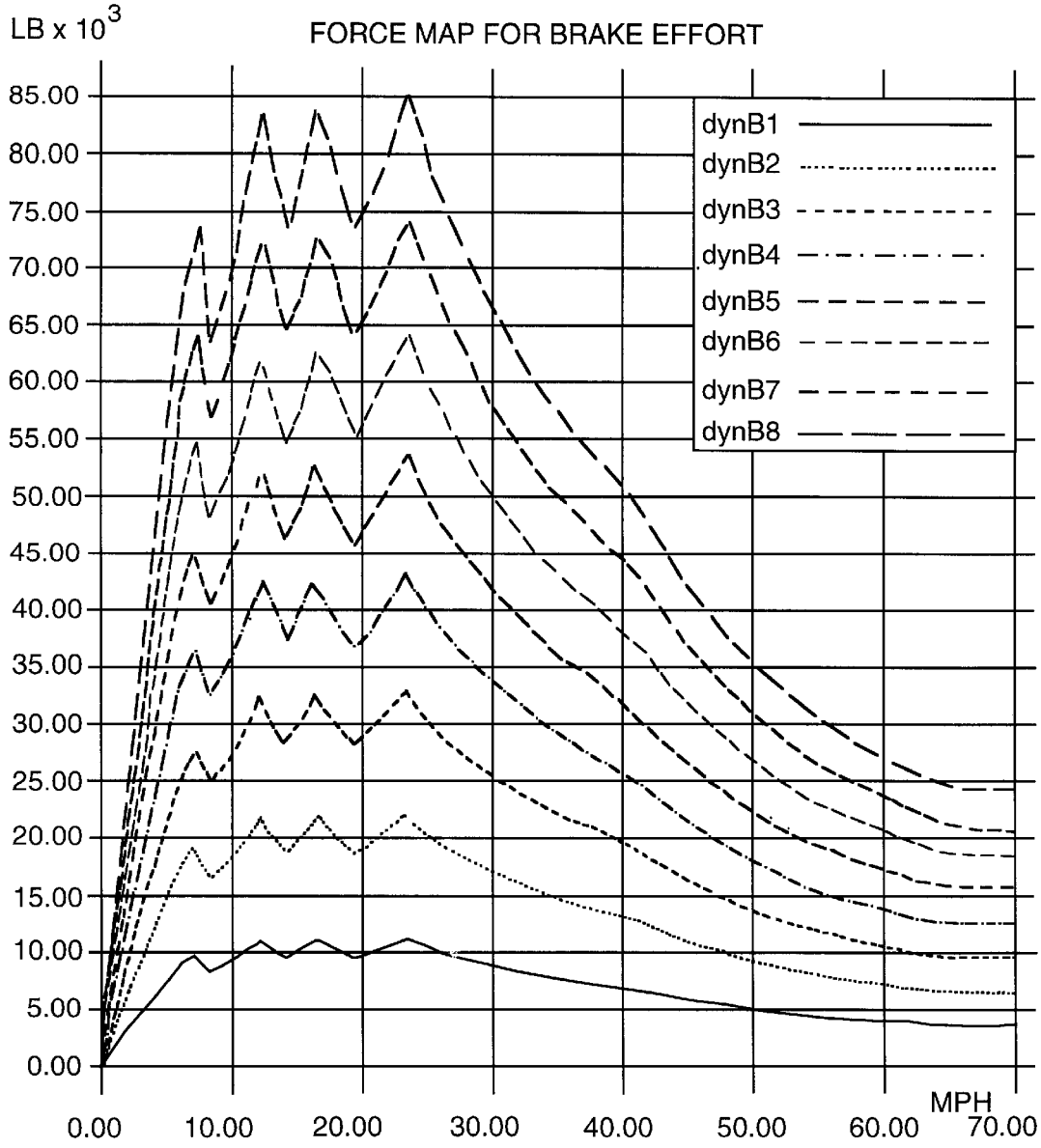

The desired change in force dF/dt to be exerted by the locomotive for the next time step is added by a summer 76 with the total force Fo determined by a train dynamics model 78. The total force Fo represents the net force being exerted for the current time step. The train dynamics model determines the total force Fo by using a train statics model 80 and a force map 82. The train statics model uses air brake data a, air resistance or drag data c, and grade data g from the inputs 66 to determine the air braking forces Fa, the grade forces on the train Fg, and the resistance forces Fc due to aerodynamic drag, track curvature, and wheel rail friction. The force map 82 uses the inputs 66 to determine the tractive forces Ft and the dynamic braking forces Fb on the train. FIGS. 13*a*–13*b* show examples of force maps used for determining the tractive forces Ft and the dynamic braking forces Fb acting on the train, respectively. The air braking forces Fa, the grade forces Fg, the resistance forces Fc, the tractive forces Ft and the dynamic braking forces Fb are used by the train dynamics model 78 to find the total forces Fo exerted on the train for the current time step. The summer 76 then adds the change in the force dF/dt with the total force Fo to obtain Fn which represent the total force to be exerted for the next time step. The force Fn is then inputted into the inverse force map which uses the value for Fn to provide recommended control action for the notch setting, dynamic brake setting, and the air brake setting. The inverse force map is substantially the same map as FIGS. 13*a*–13*b*.

As mentioned above, the fuzzy terrain matcher 70 determines the rate of change for changing the recommended control action (i.e., n, b, a) provided by the fuzzy logic control module according to the terrain. The fuzzy terrain matcher 70 is similar to the safety constraint enforcer 20 described in the first embodiment and works in substantially the same manner. In particular, the fuzzy terrain matcher 70 determines the grade value at each position along the track profile and classifies the terrain into one of seven classifications; heavy up, light up, level, light down, heavy down, dip, and knoll according to equations 16–22. The fuzzy terrain matcher then uses the current terrain and the future terrain to estimate the slack tendency behavior for the train at a particular location along the track. The estimated slack tendency is based on fuzzy rules that have been formulated for the current terrain and the future terrain that are in the form set forth in equation 23. The term set for the slack tendency as described earlier are NC, LI, HI, LO, HO, and P wherein NC means no change, LI means light run-in, HI means heavy run-in, LO means light run-out, HO means heavy run-out, and P is partial run-in and partial run-out. Once the slack tendency has been determined, then the fuzzy terrain matcher 70 uses the estimated slack tendency to provide a rate of change value for changing the recommended train handling control action. The rate of change for changing the train handling control actions are formulated into the fuzzy rules in the form set forth in equation 24 and the rule sets shown in FIG. 9.

Figure 14:
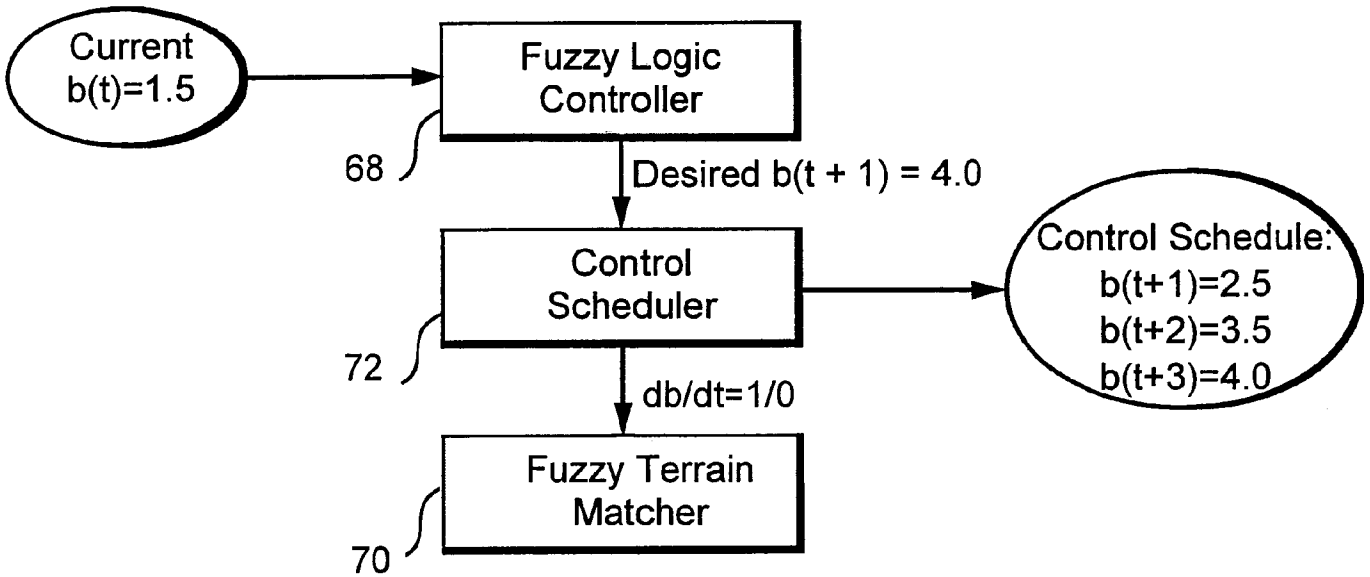
FIG. 14 shows a block diagram of a control schedule being set up for one of the train handling control actions.

The control scheduler 72 uses the recommended control action (i.e., n, b, a) generated from the fuzzy control module 68 and the rate of change (i.e., dn/dt, db/dt, da/dt) determined by the fuzzy terrain matcher 70 to generate a schedule for smoothly changing the train handling controls. In particular, the control scheduler obtains the values for the control actions at the current time step from the train simulator, the control actions for the next time step from the fuzzy logic control module, and then the rate of change determined by the fuzzy terrain matcher. The control scheduler then determines the desired control actions. FIG. 14 shows a block diagram of a control schedule that is set up for one of the train handling control actions. In this example, the current value (1.5) for the dynamic brake at a time step b(t) is inputted to the fuzzy logic control module 68. After evaluating the performance of the train simulator 60, the fuzzy logic control module 68 recommends that the desired value for the dynamic brake should be 4.0. At the same time the fuzzy terrain matcher 70 determines that the safest and smoothest way of changing the dynamic brake should be at a rate of change db/dt of 1.0. The control scheduler 72 then sets up a control schedule for changing the dynamic brake to the recommended value in accordance with the rate of change (i.e., 1.0) determined by the fuzzy terrain matcher 72. In this example, the control scheduler sets the dynamic brake value to 2.5 for the t+1 time step, 3.5 for the t+2 time step and 4.0 for the t+3 time step.

The train simulator 60 and the components of the train handling controller 58 such as the look-ahead error module 62, the fuzzy logic control module 68, the control scheduler 72 and the fuzzy terrain matcher 70 are preferably implemented in software, however, these components can be implemented in firmware or hardware. For example, the fuzzy logic control module 68 can be implemented in hardware using standard hardware (e.g., digital signal processing) or customized application specific integrated circuits (e.g., SThompson chips). Alternatively, the above components may be implemented in combinations of software, hardware or firmware.

Figure 15:
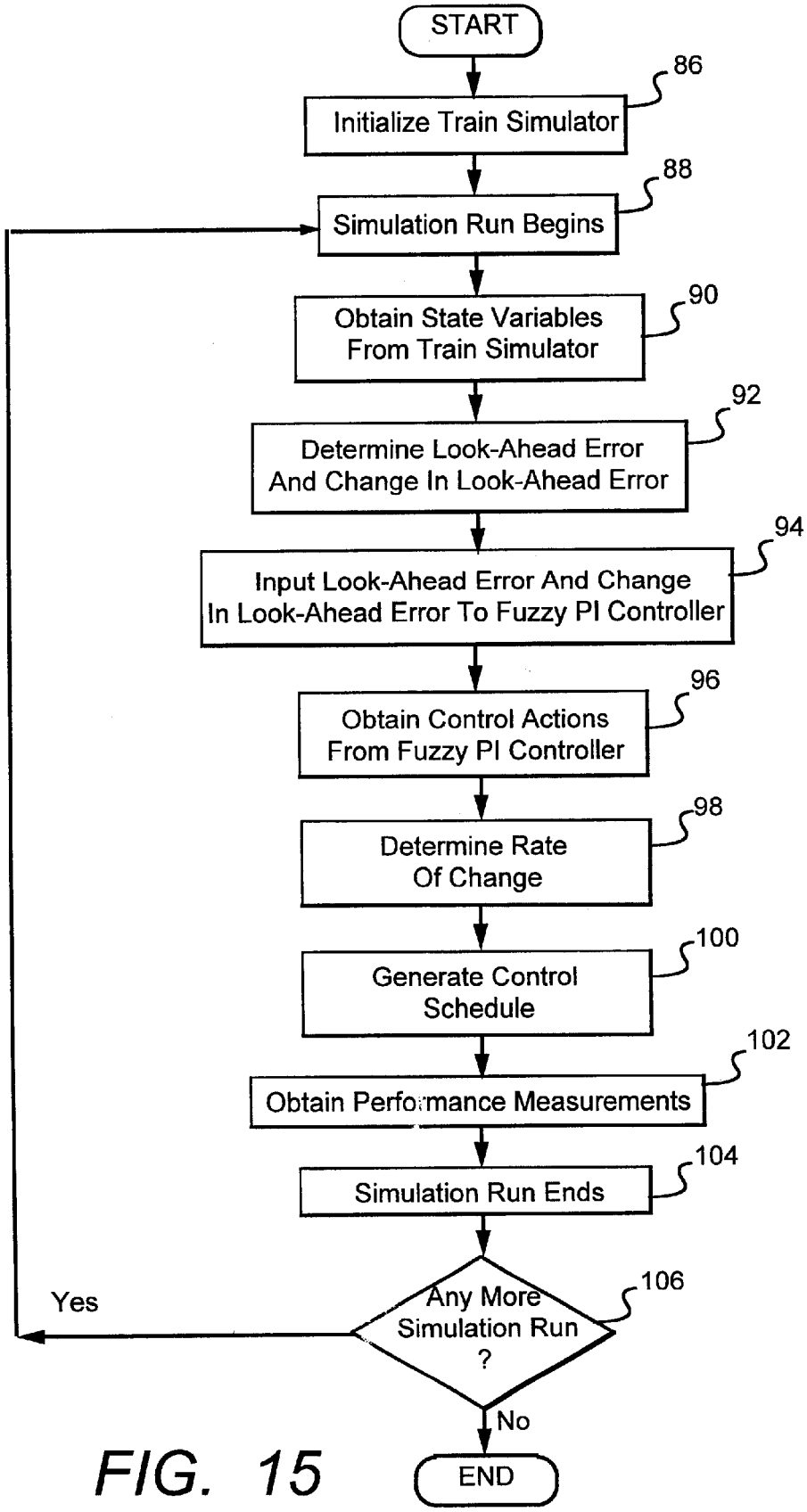
FIG. 15 shows a flow chart setting forth the operations performed according to the second embodiment of this invention.

FIG. 15 shows a flow chart setting forth the operations performed according to the second embodiment. The train simulator 60 is first initialized for a journey over a specified track profile at 86. Next, a simulation run is begun at 88. At each simulator run, state variables are obtained from the train simulator at 90. In this embodiment, the state variables are the speed of the train simulator and the position of the simulator with respect to the specified track profile. The state variables are then inputted to the look-ahead error module at 92 to obtain the look-ahead error and the change in look-ahead error. Then both the look-ahead error and the change in look-ahead error are inputted to the fuzzy logic control module at 94. The fuzzy logic control module uses the inputted look-ahead error and change in look-ahead error to recommend a control action (i.e., a change in the throttle notch, dynamic brake, and air brake settings) at 96. The fuzzy terrain matcher then determines the rate of change at 98 for safely and smoothly changing the train handling controls. The control scheduler then uses the recommended control action generated from the fuzzy control module and the rate of change determined by the fuzzy terrain matcher to generate a control schedule at 100 for smoothly changing the train handling controls. Performance measurements of the train simulator 60 such as the fuel usage, the tracking of the look-ahead error, throttle notch jockeying, etc. are then obtained at 102 and stored in a log. The simulation run then ends at 104. If it is determined that there are more simulation runs left in the journey at 106, then processing steps 88–104 are continued until there are no longer any more simulation runs.

The foregoing flow charts of this disclosure show the functionality and operation of a possible implementation of the automatic train handling controller. In this regard, each block represents a module, segment, or portion of code, which comprises one or more executable instructions for implementing the specified logical function(s). It should also be noted that in some alternative implementations, the functions noted in the blocks may occur out of the order noted in the figures, or for example, may in fact be executed substantially concurrently or in the reverse order, depending upon the functionality involved. Furthermore, the functions can be implemented in programming languages such as C++ or JAVA, however, other languages can be used.

The above-described automatic train handling controller comprises an ordered listing of executable instructions for implementing logical functions. The ordered listing can be embodied in any computer-readable medium for use by or in connection with a computer-based system that can retrieve the instructions and execute them. In the context of this application, the computer-readable medium can be any means that can contain, store, communicate, propagate, transmit or transport the instructions. The computer readable medium can be an electronic, a magnetic, an optical, an electromagnetic, or an infrared system, apparatus, or device. An illustrative, but non-exhaustive list of computer-readable mediums can include an electrical connection (electronic) having one or more wires, a portable computer diskette (magnetic), a random access memory (RAM) (magnetic), a read-only memory (ROM) (magnetic), an erasable programmable read-only memory (EPROM or Flash memory) (magnetic), an optical fiber (optical), and a portable compact disc read-only memory (CDROM) (optical). It is even possible to use paper or another suitable medium upon which the instructions are printed. For instance, the instructions can be electronically captured via optical scanning of the paper or other medium, then compiled, interpreted or otherwise processed in a suitable manner if necessary, and then stored in a computer memory.

It is therefore apparent that there has been provided in accordance with the present invention, a train handling controller that fully satisfy the aims and advantages and objectives hereinbefore set forth. The invention has been described with reference to several embodiments, however, it will be appreciated that variations and modifications can be effected by a person of ordinary skill in the art without departing from the scope of the invention.

What is claimed is:

1. A system for tracking a rail-based transportation velocity profile used with a rail-based transportation system, comprising:

a velocity profiler containing a predetermined velocity profile for operating the rail-based transportation system over a specified track profile;

a train simulator for simulating an operation of the rail-based transportation system over the specified track profile;

a fuzzy logic controller, responsive to the velocity profiler and the train simulator, for controlling the operation of the train simulator in accordance with the predetermined velocity profile, the fuzzy logic controller tracking error and change in error between the train simulator operation and the predetermined velocity profile and providing a control action to the train simulator that minimizes the error; and a safety constraint enforcer coupled to the fuzzy logic controller for ensuring that the control action provided by the fuzzy logic controller is in compliance with a set of predetermined safety constraints, wherein the safety constraint enforcer comprises a slack controller comprising means for estimating the behavior of slack throughout the operation of the train simulator.

2. The system according to claim 1, wherein the fuzzy logic controller comprises a fuzzy logic knowledge base comprising scaling factors, membership functions, and rule sets defined for the error, the change in error, and the control action.

3. The system according to claim 2, wherein the fuzzy logic controller further comprises an interpreter for relating the error and the change in error to the control action according to the scaling factors, membership functions, and rule sets in the fuzzy logic knowledge base.

4. The system according to claim 3, wherein the control action is used to modify throttle notch and brake settings for the train simulator.

5. The system according to claim 4, wherein the fuzzy logic controller is a fuzzy logic proportional integral controller.

6. The system according to claim 1, wherein the slack estimating means uses track profile, and terrain conditions to estimate the slack.

7. The system according to claim 1, wherein the safety constraint enforcer further comprises means for determining the practicability of the control action provided by the fuzzy logic controller according to the estimated slack.

8. A method for tracking a rail-based transportation velocity profile used with a rail-based transportation system, comprising the steps of:

providing a predetermined velocity profile for operating the rail-based transportation system over a specified track profile;

simulating an operation of the rail-based transportation system over the specified track profile;

controlling the operation of the train simulator with a fuzzy logic controller in accordance with the predetermined velocity profile, the fuzzy logic controller tracking error and change in error between the simulated train operation and the predetermined velocity profile and providing a control action to the simulated train operation that minimizes the error;

ensuring that the control action provided by the fuzzy logic controller is in compliance with a set of predetermined safety constraints; and estimating the behavior of slack throughout the simulated train operation.

9. The method according to claim 8, wherein the step of providing the fuzzy logic controller comprises providing a fuzzy logic knowledge base comprising scaling factors, membership functions, and rule sets defined for the error, the change in error, and the control action.

10. The method according to claim 9, wherein the step of providing the fuzzy logic controller further comprises providing an interpreter for relating the error and the change in error to the control action according to the scaling factors, membership functions, and rule sets in the fuzzy logic knowledge base.

11. The method according to claim 10, further comprising the step of using the control action to modify throttle notch and brake settings for the simulated operation.

12. The method according to claim 11, wherein the step of providing a fuzzy logic controller comprises providing a fuzzy logic proportional integral controller.

13. The method according to claim 8, wherein the step of estimating slack is based on the simulated train operation, track profile, and terrain conditions.

14. The method according to claim 8, further comprising the step of determining the practicability of the control action provided by the fuzzy logic controller according to the estimated slack.

15. A train handling controller for controlling operation of a rail-based transportation system according to a predetermined velocity profile and a specified track profile, comprising:

a train simulator for simulating the operation of the rail-based transportation system;

a look-ahead error module, responsive to the train simulator and the predetermined velocity profile, for determining the look-ahead error and change in look-ahead error;

a fuzzy logic control module coupled to the look-ahead error module, for providing a train handling control action in response to the look-ahead error and change in look-ahead error;

a fuzzy terrain matcher for determining a rate of change for changing the train handling control action provided by the fuzzy logic control module according to terrain in the specified track profile;

a control scheduler, responsive to the fuzzy logic control module and the fuzzy terrain matcher, for generating a schedule for changing the train handling control action provided to the train simulator according to the determined rate of change and changing the train handling control action in accordance with the schedule.

16. The controller according to claim 15, wherein the fuzzy logic control module comprises:

a train dynamics module for determining the total forces acting on the train simulator;

a fuzzy logic controller for determining a change in force acting on the train simulator;

an inverse force map for mapping the sum of the total forces and change in force into the train handling control action.

17. The controller according to claim 16, wherein the fuzzy logic controller comprises a fuzzy logic knowledge base defined for the look-ahead error, the change in look-ahead error, and the change in force and an interpreter for relating the look-ahead error and the change in look-ahead error to the change in force.

18. The controller according to claim 15, wherein the train handling control action comprises adjusting the throttle notch setting, the dynamic brake setting and the air brake setting.

19. The controller according to claim 15, wherein the fuzzy terrain matcher comprises a rule set for mapping the current terrain and future terrain of the specified track profile into a slack tendency estimate and a rate of change for changing the train handling control action.

* * * * *

UNITED STATES PATENT AND TRADEMARK OFFICE

CERTIFICATE OF CORRECTION

PATENT NO. : 6,760,712 B1 
DATED : July 6, 2004
INVENTOR(S) : Piero P. Bonissone et al.

It is certified that error appears in the above-identified patent and that said Letters Patent is hereby corrected as shown below:

Column 5,
Line 60, please delete "wherein a(s) is the current acceleration of the train. This is" and insert -- wherein *a(s)* is the current acceleration of the train. This is --

Signed and Sealed this

Fourth Day of January, 2005

JON W. DUDAS
*Director of the United States Patent and Trademark Office*